US008191992B2

(12) United States Patent
Lin et al.

(10) Patent No.: US 8,191,992 B2
(45) Date of Patent: Jun. 5, 2012

(54) PROTECTIVE COATINGS FOR SOLID INKJET APPLICATIONS

(75) Inventors: Liang-Bih Lin, Rochester, NY (US); Pinyen Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 680 days.

(21) Appl. No.: 12/334,848

(22) Filed: Dec. 15, 2008

(65) Prior Publication Data

US 2010/0149262 A1 Jun. 17, 2010

(51) Int. Cl.
*B41J 2/14* (2006.01)
*B05D 1/32* (2006.01)

(52) U.S. Cl. ..... 347/47; 427/466

(58) Field of Classification Search ..... 347/40, 347/43, 47; 427/466
See application file for complete search history.

(56) References Cited

U.S. PATENT DOCUMENTS

| | | | |
|---|---|---|---|
| 3,689,571 | A | 9/1972 | Regan et al. |
| 4,565,867 | A | 1/1986 | Thomas et al. |
| 4,980,501 | A | 12/1990 | Scheben |
| 5,179,188 | A | 1/1993 | Mercer et al. |
| 5,212,496 | A | 5/1993 | Badesha et al. |
| 5,218,381 | A | 6/1993 | Narang et al. |
| 5,264,637 | A | 11/1993 | Yoshida et al. |
| 5,291,226 | A | 3/1994 | Schantz et al. |
| 5,721,363 | A | 2/1998 | Canzi et al. |
| 6,258,950 | B1 | 7/2001 | van Wijck |
| 6,294,704 | B1 | 9/2001 | Takaki et al. |
| 6,313,357 | B1 | 11/2001 | Yamaguchi et al. |
| 6,357,865 | B1 | 3/2002 | Kubby et al. |
| 6,392,105 | B1 | 5/2002 | Yoshizawa et al. |
| 6,410,808 | B1 | 6/2002 | Furukawa et al. |
| 6,416,683 | B1 | 7/2002 | Klug et al. |
| 6,579,980 | B2 | 6/2003 | Tjioe |
| 6,677,492 | B2 | 1/2004 | Bieniarz et al. |
| 7,034,179 | B2 | 4/2006 | Okazoe et al. |
| 7,053,237 | B2 | 5/2006 | Okazoe et al. |
| 7,161,025 | B2 | 1/2007 | Okazoe et al. |
| 7,186,828 | B2 | 3/2007 | Guichard et al. |
| 7,193,119 | B2 | 3/2007 | Nagai et al. |
| 7,220,882 | B2 | 5/2007 | Porro et al. |
| 7,265,222 | B2 | 9/2007 | Haddad et al. |
| 7,312,288 | B2 | 12/2007 | Kinsho et al. |
| 7,314,949 | B2 | 1/2008 | Goredema et al. |
| 7,354,933 | B2 | 4/2008 | Patek et al. |
| 2003/0020785 | A1 | 1/2003 | Andrews |
| 2005/0285901 | A1 | 12/2005 | Nelson et al. |
| 2006/0132539 | A1* | 6/2006 | Hino et al. ..... 347/47 |

* cited by examiner

*Primary Examiner* — Lamson Nguyen
(74) *Attorney, Agent, or Firm* — Oliff & Berridge, PLC

(57) ABSTRACT

An aperture plate coated with a composition including a first monomer, a second monomer, a fluorinated compound, such as fluorosilane, fluoroalkyl amide, fluorinated ether and the like, and a photoinitiator, where the first and second monomer are different. A process of coating an aperture plate includes applying the compositions to a base film, such as a polyimide film, and curing the compositions on the base film.

20 Claims, No Drawings

PROTECTIVE COATINGS FOR SOLID INKJET APPLICATIONS

BACKGROUND

This disclosure relates to solid inkjet printheads. In inkjet printing, a printhead is provided, the printhead having at least one ink-filled channel for communication with an ink supply chamber at one end of the ink-filled channel. An opposite end of the ink-filled channel has a nozzle opening from which droplets of ink are ejected onto a recording medium. In accordance with the ink droplet ejection, the printhead forms an image on the recording medium. The ink droplets are formed as ink forms a meniscus at each nozzle opening prior to being ejected from the printhead. After a droplet is ejected, additional ink surges to the nozzle opening to reform, the meniscus.

The direction of the ink jet determines the accuracy of placement of the droplet on the receptor medium, which, in turn, determines the quality of printing performed by the printer. Accordingly, precise jet directionality is an important property of a high quality printhead. Precise jet directionality ensures that ink droplets will be placed precisely where desired on the printed document. Poor jet directionality results in the generation, of deformed characters and visually objectionable banding in halftone pictorial images. Particularly with the newer generation of thermal inkjet printers having higher resolution enabling printing at least 360 dots per inch, improved print quality is demanded by customers.

A major source of ink jet misdirection is associated with improper wetting of the front face of the printhead containing at least one nozzle opening. One factor that adversely affects jet directional accuracy is the accumulation of dirt and debris, including paper fibers, on the front face of the printhead. Another factor that adversely affects jet directional accuracy is the interaction of ink previously accumulated on the front face of the printhead with the exiting droplets. This accumulation is a direct consequence of the forces of surface tension, the accumulation becoming progressively severe with aging due to chemical degradation (including, for example, oxidation, hydrolysis, reduction (of fluorine), etc.) of the front face of the printhead. Ink may accumulate on the printhead front face due to either overflow during the refill surge of ink or the splatter of small droplets resulting from the process of ejecting droplets from the printhead. When accumulated ink on the front face of the printhead makes contact with ink in the channel (and in particular with the ink meniscus at the nozzle orifice), the meniscus distorts, resulting in an imbalance of forces acting on the ejected droplet. This distortion leads to ink jet misdirection. This wetting phenomenon becomes more troublesome after extensive use of the printhead as the front face either chemically degrades or becomes covered with dried ink film. As a result, gradual deterioration of the generated image quality occurs.

One way of avoiding these problems is to control the wetting characteristics of the printhead front face so that no accumulation of ink occurs on the front face even after extensive printing. Thus, in order to provide accurate ink jet directionality, wetting of the front face of the printhead is suppressed. This can be achieved by rendering the printhead front face hydrophobic.

Conventionally, a solid inkjet printhead has been built with stainless steel plates etched chemically or punched mechanically. There has been significant effort recently to reduce the cost of solid inkjet printheads. One opportunity is to replace the stainless steel aperture plate with a polyimide aperture plate. For stainless steel material, the aperture was punched mechanically. Therefore, by replacing it with a polyimide film that can be laser cut, it is possible to eliminate issues with defects and limitations in the punched stainless steel. In addition, a polyimide aperture plate significantly reduces manufacturing costs as compared to the punched stainless steel plate. The hole size and size distribution are comparable to stainless steel aperture plates in a polyimide plate.

Polyimide is used in many electronic applications for its many advantages, such as high strength, heat resistant, stiffness and dimensional stability. In solid inkjet printheads, it can be used as an aperture plate for ink nozzles. However, without an anti-wetting or hydrophobic coating, the front face will flood with ink and the jetting cannot be done. But the high surface energy nature of the polymer can cause some issues. Therefore, protective coatings with low surface energy characteristics are key to long lasting devices.

For example, U.S. Pat. No. 5,218,381, incorporated herein by reference in its entirety, describes a coating comprising an epoxy adhesive resin such as EPON 1001F, for example, doped with a silicone rubber compound such as RTV 732. The coating can be provided in the form of a 24% solution of EPON 1001F and a 30:70 mixture of xylene and methyl iso-butyl ketone by weight doped with 1% by weight of RTV 732. Such a coating enables the directionality of an inkjet to be maintained for the printing lifetime of the printer. An adhesion promoter such as a silane component, for example, can also be included to provide a highly adherent, long lasting coating.

While laser ablated nozzle plates are able to provide excellent drop ejector performance, a practical problem in so forming the nozzle plates is that while polymer materials used for the nozzle plate, for example polyimides, are laser ablatable with lasers such as excimer lasers, such polymers are not hydrophobic. It is thus necessary to provide a hydrophobic coating upon the surface of the nozzle plate to render the front face hydrophobic to improve the inkjet accuracy as discussed above. However, coating polyimide is not commonly done in industry. Polyimide is chemically and thermally stable, and many coating agents cannot easily form a thin and uniform coating on the surface.

U.S. Patent Application Publication No. 2003/0020785, which, is incorporated herein by reference in its entirety, discloses a laser ablatable hydrophobic fluorine-containing polymer coating.

Conventionally, the aperture surface would be coated with fluoropolymer for anti-wetting purposes. Without the anti-wetting coating, the front face of the printhead will flood with ink and the ink cannot be jetted out of the nozzle. The coating process is performed by evaporating fluoropolymer in a high vacuum chamber at elevated temperature. It is a batch process with printheads loaded and unloaded to and from the chamber for the coating, which is an expensive process. In addition, the fluoropolymer tends to coat the side wall of the nozzles and inside the ink channels. The control of the degree of such inside coating is difficult and has significant impact on ink drop performance.

Fluorinated compounds like fluoropolymers, in particular poly(tetrafluoroethylene) (PTFE), are used extensively in low surface energy protective coatings to achieve wear resistance and environmental stability. For certain applications, where micro-particles of PTFE are required for mixing with other resins/binders, residues flake off and discharge of the micro-particles after wear and tear can be a severe issue. Homogeneous coatings comprised of low surface energy moieties are more desirable. Unfortunately, in order to gain enough integrity, the low surface energy material must be compatible and best chemically linked with other components. Moreover, proper adhesion of the protective coatings to the base polymer, polyimide, is also critical. Further, concerns regarding environmental safety and energy conservation suggests the desirable feature of radiation curable systems in order to eliminate or substantially reduce the use of solvents.

SUMMARY

In order to solve the above-identified problems, this disclosure provides an aperture plate coated with a composition comprising a first monomer, such as dipropylene glycol diacrylate, a second monomer, such as aliphatic epoxy acrylate, a fluorinated compound, such as fluorosilane, fluoroalkyl amide, fluorinated ether and the like, and a photoinitiator, where the first monomer is different from the second monomer.

This disclosure also provides a process of applying a coating composition to an aperture plate, comprising a first monomer, such as dipropylene glycol diacrylate, a second monomer, such as aliphatic epoxy acrylate, a fluorinated compound, such as fluorosilane, fluoroalkyl amide, fluorinated ether and the like, and a photoinitiator, where the first monomer is different from the second monomer.

This disclosure also describes replacing a conventional stainless steel aperture plate with polyimide film, where the polyimide film is coated with the above-described coating composition before a laser cutting process. Thin coating composition can be done in a continuous process, eliminating the costly evaporation batch process. Therefore, one can bond either: a) a conventional stainless steel aperture plate with coated polyimide film; or b) a coated polyimide film (without a stainless steel plate) that functions as an aperture plate, on to the remaining jet stack to complete the inkjet printhead.

EMBODIMENTS

In embodiments, this disclosure provides an aperture plate coated with a composition comprising a first monomer, such as dipropylene glycol diacrylate, a second monomer, such as aliphatic epoxy acrylate, a fluorinated compound and a photoinitiator.

In embodiments, any fluorinated compound can be used. For example, a fluorosilane, a fluoroalkyl amide, fluorinated ether, a combination thereof, and the like may be used. A fluorinated silane, fluorosilane, can be used as the fluorinated compound. An example of a specific fluorosilane is Fluorolink S10 by Solvay Solexis. A fluorinated alkyl amide, or fluoroalkyl amide, can also be used as the fluorinated compound. An example of a specific fluoroalkyl amide is Fluorolink A10 by Solvay Solexis.

In one embodiment of the present disclosure, the fluorinated compound is a perfluoropolyether (PFPE). Representative examples of commercially available PFPE include, for example, Fomblin M®, Fomblin Y®, and Fomblin Z® families of lubricants from Solvay Solexis; Krytox® from E.I. du Pont de Nemours and Company; and Demnum™ from Daikin Industries, Limited. In another embodiment of the disclosure, the fluorinated compound is a functionalized PFPE, which is a fluorinated PFPE compound that is substituted by one or more functional groups. Suitable functional groups include, for example, alcohol, silane, and siloxane. Representative examples of commercially available functionalized PFPE include, for example, Fomblin ZDOL®, Fomblin ZDOL TXS®, Fomblin ZDIAC®, Fluorolink A10®, Fluorolink C®, Fluorolink D®, Fluorolink E®, Fluorolink E10®, Fluorolink F10®, Fluorolink L®, Fluorolink L10®, Fluorolink S10®, Fluorolink T®, and Fluorolink T10®, from Solvay Solexis as shown in Table 3. In yet another embodiment of the disclosure, the functionalized PFPE may be in the form of an emulsion. Representative examples of commercially available functionalized PFPE emulsions are, for example, Fomblin FE-20C® and Fomblin FE-20AG® from Solvay Solexis. In some embodiments, the fluorinated compound can include other halogen atoms in addition to a fluorine atom. Thus, for example, in yet another embodiment of the disclosure, the fluorinated compound can be a chlorofluoroalkylene, such as chlorotrifluoroethylene. A representative example of commercially available chlorotrifluoroethylene is, for example, Daifloil™ from Daikin Industries, Limited.

In embodiments, this disclosure provides examples of a suitable first monomer for the composition to include, but are not limited to, styrene monomers, such as styrene and α-methylstyrene; acrylic esters, such as methyl acrylate, α-ethylhexyl acrylate, methoxyethyl acrylate, butoxyethyl acrylate, butyl acrylate, methoxybutyl acrylate, and phenyl acrylate; methacrylic esters, such as methyl methacrylate, ethyl methacrylate, propyl methacrylate, methoxyethyl methacrylate, ethoxymethyl methacrylate, phenyl methacrylate, and lauryl methacrylate; unsaturated substituted-type substituted amino alcohol esters, such as 2-(N,N-diethylamino)ethyl acrylate, 2-(N,N-dimethylamino)ethyl acrylate, 2-(N,N-dibenzylamino)methyl acrylate, and 2-(N,N-diethylamino)propyl acrylate; unsaturated carboxylic acid amides, such as acrylamide and methacrylamide; compounds, such as ethylene glycol diacrylate, propylene glycol diacrylate, neopentyl glycol diacrylate, 1,6-hexanediol diacrylate, and methylene glycol diacrylate; polyfunctional compounds, such as dipropylene glycol diacrylate, ethylene glycol diacrylate, propylene glycol dimethacrylate, and diethylene glycol dimethacrylate; and/or polythiol compounds having two or more thiol groups in the molecule thereof, for example, trimethylolpropane trithioglycolate, trimethylolpropane trithiopropylate, and pentaerythritol tetrathioglycolate.

In embodiments, this disclosure provides examples of a suitable second monomer for the composition to include, for example, but are not limited to, aliphatic epoxy(meth)acrylates; monofunctional (poly)ether(meth)acrylates such as butoxyethyl(meth)acrylate, butoxytrietheylene glycol(meth) acrylate, epichlorohydrin-modified butyl(meth)acrylate, dicyclopentanyloxyethyl(meth)acrylate, 2-ethoxyethyl (meth)acrylate, ethylcarbitol(meth)acrylate, 2-methoxy (poly)ethylene glycol (meth)acrylate, methoxy(poly)propylene glycol (meth)acrylate, nonylphenoxypolyethylene glycol (meth)acrylate, nonylphenoxypolypropylene glycol (meth)acrylate, phenoxyhydroxpropyl(meth)acrylate, phenoxy(poly)ethylene glycol (meth)acrylate, polyethylene glycol mono(meth)acrylate, and polypropylene glycol mono (meth)acrylate; alkylene glycol di(meth)acrylates such as polyethylene glycol di(meth)acrylate, polypropylene glycol di(meth)acrylate, polybutylene glycol di(meth)acrylate, and polytetramethylene glycol di(meth)acrylate; polyfunctional (meth)acrylates induced by (meth)acrylic acid with aliphatic polyols such as a copolymer of ethylene oxide and propylene oxide, a copolymer of propylene glycol and tetrahydrofuran, a copolymer of ethylene glycol and tetrahydrofuran, polyisoprene glycol, hydrogenated polyisoprene glycol, polybutadieneglycol, hydrogenated poybutadiene glycol; polyfunctional (meth)acrylates induced by acrylic acid with polyhydric alcohols such as polytetramethylenehexaglyceryl ether (tetrahydrofuran-modified hexaglycerin); di(meth) acrylates of diol obtained by addition of equimolar or more than 1 mole of cyclic ethers such as ethylene oxide, propylene oxide, butylene oxide and/or tetrahydrofuran to 1 mole of neopentyl oxide; di(meth)acrylates of alkylene-oxide modified bisphenols such as bisphenol A, bisphenol F and bisphenol S; di(meth)acrylate of alkylene oxide-modified hydrogenated bisphenols such as hydrogenated bisphenol A, hydrogenated bisphenol F, hydrogenated bisphenol S; di(meth)acrylates of alkylene oxide-modified trisphenols; di(meth)acrylates of alkylene oxide-modified hydrogenated trisphenols; di(meth)acrylates of alkylene oxide-modified p,p'-bisphenots; di(meth)acrylates of alkylene oxide-modified hydrogenated bisphenols; di(meth)acrylates of alkylene oxide-modified p,p'-dihydroxybenzophenones, mono-, di- and tri-(meth)acrylates of triols obtained by addition of equimolar or more than 1 mole of ethylene oxide, propylene oxide, butylene oxide, and/or cyclic ethers such as tetrahydrofuran to 1 mole of trimethylelolpropane or glycerin; mono-, di-, tri- or tetraqmeth)acrylates obtained by addition of equimolar or more than 1 mole to ethylene oxide, propylene oxide, butylene oxide, and/or cyclic ethers such as tetrahydrofuran to 1 mole of pentaerylthritol, ditrimethylolpropane or highly alkoxylated trimethylolpropane triacrylate; and mono functional (poly)ether (meth)acrylates or polyfunctional (poly)ether(meth)acrylates of polybydric alcohols such as triol, tetraol, pentaol, or hexaol of mono- or poly-(meth)acrylates.

The coating compositions can contain a first monomer and a second monomer in a suitable weight ratio of, for example, about 90:10 to about 60:40, such as 85:15 to about 75:25, or such as about 80:20.

In embodiments, the photoinitiator can be, for example, 2-benzyl-2-(dimethylamino)-4'-morpholinobutyrophenone; 2-hydroxy-2-methylpropiophenone; trimethylbenzophenone; methylbenzophenone; 1-hydroxycyclohexylphenyl ketone; isopropyl thioxanthone; 2,2-dimethyl-2-hydroxy-acetophenone; 2,2-dimethoxy-2-phenylacetophenone; 2-methyl-[4-(methylthio)phenyl]-2-morpholino-propan-1-one; 2,4,6-trimethylbenzyl-diphenyl-phosphine oxide; 1-chloro-4-propoxythioxanthone; benzophenone; bis(2,6-dimethoxybenzoyl)-2,4,4-trimethyl pentyl phosphine oxide; 1-phenyl-2-hydroxy-2-methyl propanone; bis(2,4,6-trimethylbenzoyl) phenylphosphine oxide; camphorquinone; and the like. Combinations comprising two or more the foregoing may also be used. Suitable commercially available photoinitiators include, but are not limited to Irgacure 907, Irgacure 819, Irgacure 2959, Irgacure 184, Irgacure 369, Irgacure 379, Irgacure 651 and Darocur D1173, commercially available from Ciba Specialty Chemicals ("Ciba") benzophenone, Genocure LBP, commercially available from Rahn, ITX SarCure SR1124 and TZT SarCure SR1137, commercially available from Sartomer, Chivacure BMS, commercially available from Chitec Technology Co., and combinations thereof.

In addition to the disclosed embodiment compositions comprising a first monomer, a second monomer, a fluorinated compound and a photoinitiator the composition can also include any other known additive or ingredient.

This disclosure also provides a process of applying a coating composition to an aperture plate. The process generally comprises adding a first monomer, a second monomer, a fluorinated compound and a photoinitiator to form a coating composition, applying the coating composition to a base film, and curing the base film. The polyimide films can be treated with plasma prior to the coating process to create active functional groups such as hydroxyl and acidic groups and unsaturated double bonds on polyimide chain. Typical plasma gases are oxygen and inert gases such as nitrogen and argon. It is also possible to treat polyimide surface with chemical solutions, such as potassium hydroxide to create functional groups on the polyimide surface prior to the coating process. The functional groups on polyimide can form chemical bonds with coating materials to enhance the adhesion of coating materials with polyimide.

In the process of preparing a coating composition, any suitable solvent can be used, if desired, although a solvent is not required. Suitable solvents include, for example, alcohol, ketone, acetate, THF, toluene, and the like.

In an embodiment, a first monomer, a second monomer, a fluorinated compound and a photoinitiator react to form a product on the substrate.

Next, the coatings are applied to a base film, such as a polymeric base film such as a polyimide base film, using any suitable coating process readily available in the art. For example, the coating can be applied using a bar coating block with a gap height. Then, the coating composition is cured to form a final coating film, for example, the composition can be cured under UV light from about 10 seconds to about 10 minutes.

Any polyimide base film can be used, such as Dupont® Kapton, or Upilex® from Ube Industries, to form the desired ink jetting apparatus or other features. Other polyimide base films include, for example, thermoplastic polyimide film ELJ100 from DuPont®.

After the coating composition is cured on the base film, the aperture plate can be cut with a laser, for example to form the desired ink setting aperture or other features. Thus, the coating composition can be cured onto the base film in a continuous process.

A base film, such as a base film, with this coating composition can be carried out with a web-based continuous coating process. This can eliminate current batch evaporation process. This is a significant cost-cutting and time-saving opportunity for the production, of SIJ printheads.

The printhead in this disclosure can be of any suitable configuration without restriction. The inkjet printhead comprises a plurality of channels, wherein the channels are capable of being filled with ink from an ink supply and wherein the channels terminate in nozzles on one surface of the printhead, the surface of which is coated with the hydrophobic laser ablatable fluorine-containing graft copolymer as discussed above. Suitable inkjet printhead designs are described in, for example, U.S. Pat. No. 5,291,226, U.S. Pat. No. 5,218,381 and U.S. Pat. No. 5,212,496, and U.S. Patent Application Publication No. 2005/0285901, all of which are incorporated herein by reference in their entireties. Further explanation of the inkjet printhead and the remaining well known components and operation thereof is accordingly not undertaken, again in the present application.

Examples are set forth below and are illustrative of different compositions and conditions that can be utilized in practicing the disclosure. All proportions are by weight unless otherwise indicated. It will be apparent, however, that the disclosure can be practiced with many types of coating compositions and can have many different uses in accordance with the disclosure above and as pointed out hereinafter.

EXAMPLES

Example 1

A coating composition was formulated with dipropylene glycol diacrylate (Laromer DPGDA) and aliphatic epoxy acrylate (Laromer LR8765) at about 80:20 ratio in weight with 10% fluoroalkyl amide (Fluorolink A10) and 5% photoinitiator (Irgacure 379). The formulation was mixed, coated with a 0.2 mil (~5 μm) Bird-bar block, applied to a DuPont® Kapton polyimide substrate, and cured under UV light for about 1 minute. The coating was readily cured with good adhesion to the polyimide substrate and solvent resistance.

The surface energy was analyzed using water contact angle measurements and exhibited a water contact angle of about 57°. Scratch resistance was determined by the pencil hardness test and was found to be 4H.

Example 2

A coating composition was formulated with dipropylene glycol diacrylate (Laromer DPGDA) and aliphatic epoxy acrylate (Laromer LR8765) at about 80:20 ratio in weight and with 5% fluorosilane (Fluorolink S10) and 5% photoinitiator (Irgacure 379). The formulation was mixed, coated with a 0.2 mil (~5 μm) Bird-bar block, applied to a DuPont® Kapton polyimide substrate, and cured under UV light for about 1 minute. The coating was readily cured with good adhesion to tire polyimide substrate and solvent resistance.

The surface energy was analyzed using water contact angle measurements and exhibited a water contact angle of about $10^{6\circ}$. Scratch resistance was determined by the pencil hardness test and was found to be 4H.

Example 3

A coating composition was formulated with dipropylene glycol diacrylate (Laromer DPGDA) and aliphatic epoxy acrylate (Laromer LR8765) at about 80:20 ratio in weight and with 10% fluorosilane (Fluorolink S10) and 2% photoinitiator (Irgacure 379). The formulation was mixed, coated with a 0.2 mil (~5 μm) Bird-bar block, applied to a DuPont® Kapton polyimide substrate, and cured under UV light for about 1 minute. The coating was readily cured with good adhesion to the polyimide substrate and solvent resistance.

The surface energy was analyzed using water contact angle measurements and exhibited, a water contact angle of about 103°. Scratch resistance was determined by the pencil hardness test and was found, to be 4H.

Example 4

A coating composition was formulated with dipropylene glycol diacrylate (Laromer DPGDA) and aliphatic epoxy acrylate (Laromer LR8765) at about 80:20 ratio in weight and with 5% fluoroalkyl amide (Fluorolink A10) and 2% photoinitiator (Irgacure 379). The formulation was mixed, coated with a 0.2 mil (5 μm) Bird-bar block, applied to a DuPont® Kapton polyimide substrate, and cured under UV light for about 1 minute. The coating were readily cured with good adhesion to the polyimide substrate and solvent resistance.

The surface energy was analyzed using water contact angle measurements and exhibited a water contact angle of about 60°. Scratch resistance was determined by the pencil hardness test and was found to be 4H.

Control Example

A control sample was formulated containing dipropylene glycol diacrylate (Laromer DPGDA) and aliphatic epoxy acrylate (Laromer LR8765) at about 80:20 ratio in weight and 2% photoinitiator (Irgacure 379). No fluorinated compounds were present in the control sample. The surface energy was analyzed using water contact angle measurements and exhibited a water contact angle of about 75-85°. Scratch resistance was determined by the pencil hardness test and was found to be 2H.

Table 1 summarizes the results of the various coating composition formulations of Examples 1-4 in comparison to each other and the Control Example.

Table 1

TABLE 1

| Example | Water Contact Angle | Formulation | Pencil Hardness |
|---|---|---|---|
| 1 | 57° ± 3 | 10% Fluorolink A10, 5% Irgacure379 | 4H |
| 2 | 106° ± 1 | 5% Fluorolink S10, 5% Irgacure379 | 4H |
| 3 | 103° ± 1 | 10% Fluorolink S10, 2% Irgacure379 | 4H |
| 4 | 60° ± 1 | 5% Fluorolink A10, 2% Irgacure379 | 4H |
| Control | 75-85° | 2% Irgacure379 | 2H |

Analysis of the results of Table 1 demonstrates that an equivalent amount of the fluorosilane increases the water contact angle by almost two fold when compared with the fluoroalkyl amide; comparison of Examples 1 versus 3 and Example 2 versus 4. Further, an increase in fluorosilane demonstrates an approximately equivalent water contact angle; comparison of Examples 2 versus 3. Similarly, an increase in the amount of the fluoroalkyl amide results in an approximately equal water contact angle; comparison of Examples 1 versus 4. Thus, fluorosilane (Fluorolink S10) is very effective in lowering surface energy, whereas the fluoroalkyl amide (Fluorolink A10) actually induces lower water contact angles.

Scratch, resistance of the protective coatings were determined by the pencil hardness test and the results suggest that there is no difference in hardness between the protective coatings (Table 1).

Examples 5 and 6

The cured, coated polyimide films of Examples 2 and 3, respectively, were then reheated in an oven at about 250° C. for approximately 120 minutes in order to stimulate harsher conditions and stresses that are procedurally similar to films conventionally manufactured (about 200° C. for about 20-30 minutes).

Accordingly similar to the above examples, the surface energy of the reheated films were analyzed using water contact angle measurements.

Table 2 summarizes the results of the coated substrates of Examples 5 and 6 after being subjected to an extreme heat environment.

Table 2

TABLE 2

| Example | Water Contact Angle | Formulation | Pencil Hardness |
|---|---|---|---|
| 5 | 107° ± 1 | 5% Fluorolink S10, 5% Irgacure 379 | 5H |
| 6 | 107° ± 1 | 10% Fluorolink S10, 2% Irgacure 379 | 4H |

Comparatively, Examples 5 and 6 demonstrated no degradation in contact angle, wherein the compositions containing varying amounts of fluorosilane (5% and 2% Fluorolink S10) exhibited approximately equivalent contact angle measurements (107°±1) and therefore, approximately equivalent surface energies (Table 2). Additionally, the pencil hardness for the compositions remained negligibly unchanged, wherein the pencil hardness for Example 5 is 5H and the pencil hardness for Example 6 is 4H.

In addition to the low surface energy, the protective UV cured coating film also show good adhesion, thermal stability and robustness against wear. A polyimide nozzle plate, together with the UV curable solvent-less web-coating manufacturing process, creates a significant cost-cutting opportunity. Therefore, the results demonstrate that a composition of a first monomer, a second monomer, a fluorinated compound, and a photoinitiator, such as a compositions of dipropylene glycol diacrylate, aliphatic epoxy acrylate, and fluorosilane, can be UV cured on polyimide substrates and maintain low surface energy characteristics even when subjected/exposed to high temperatures.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An aperture plate coated with a composition comprising a first monomer, a second monomer, a fluorinated compound, and a photoinitiator, wherein said first monomer is different from said second monomer and wherein a weight ratio of the first monomer to the second monomer is from about 90:10 to about 60:40.

2. The aperture plate according to claim 1, wherein the aperture plate is a polyimide aperture plate.

3. The aperture plate according to claim 1, wherein said first monomer is a polyfunctional compound selected from the group consisting of dipropylene glycol diacrylate, ethylene glycol diacrylate, propylene glycol dimethacrylate, and diethylene glycol dimethacrylate.

4. The aperture plate according to claim 3, wherein said polyfunctional compound is dipropylene glycol diacrylate.

5. The aperture plate according to claim 1, wherein said second monomer is selected from the group consisting of aliphatic epoxy acrylate, monofunctional (poly)ether(meth) acrylate, alkylene glycol di(meth)acrylate, polyfunctional (meth)acrylate, and di(meth)acrylate.

6. The aperture plate according to claim 5, wherein said second monomer is an aliphatic epoxy acrylate.

7. The aperture plate according to claim 1, wherein the weight ratio is about 80:20.

8. The aperture plate according to claim 1, wherein said fluorinated compound is a perfluoropolyether.

9. The aperture plate according to claim 8, wherein said perfluoropolyether is a functionalized perfluoropolyether.

10. The aperture plate according to claim 9, wherein said functionalized perfluoropolyether is a silane functionalized perfluoropolyether.

11. The aperture plate according to claim 1, wherein said first monomer is dipropylene glycol diacrylate, said second monomer is aliphatic epoxy acrylate, and said fluorinated compound is fluorosilane.

12. A process of forming a coated aperture plate, comprising:

applying a coating composition comprising a first monomer, a second monomer, a fluorinated compound, and a photoinitiator to a base film; and curing the coating composition on the base film, wherein said first monomer is different from said second monomer, and wherein a weight ratio of the first monomer to the second monomer is from about 90:10 to about 60:40.

13. The process according to claim 12, wherein the aperture plate is a polyimide aperture plate.

14. The process according to claim 12, wherein said first monomer is a polyfunctional compound selected from the group consisting of dipropylene glycol diacrylate, ethylene glycol diacrylate, propylene glycol dimethacrylate, and diethylene glycol dimethacrylate.

15. The process according to claim 12, wherein said second monomer is selected from the group consisting of aliphatic epoxy acrylate, monofunctional (poly)ether(meth)acrylate, alkylene glycol di(meth)acrylate, polyfunctional (meth)acrylate, and di(meth)acrylate.

16. The process according to claim 12, wherein said fluorinated compound is a perfluoropolyether.

17. The process according to claim 16, wherein said perfluoropolyether is a functionalized perfluoropolyether.

18. The process according to claim 17, wherein the fluorinated compound is selected from the group consisting of a fluorosilane.

19. The process according to claim 12, wherein a weight ratio of said first monomer to said second monomer is from about 90:10 to about 60:40.

20. An aperture plate coated with a composition comprising a first monomer selected from the group consisting of dipropylene glycol diacrylate, ethylene glycol diacrylate, propylene glycol dimethacrylate, diethylene glycol dimethacrylate and mixtures thereof, a second monomer selected from the group consisting of aliphatic epoxy acrylate, monofunctional (poly)ether (meth)acrylate, alkylene glycol di(meth)acrylate, polyfunctional (meth)acrylate, di(meth)acrylate and mixtures thereof, a fluorinated compound that is a silane functionalized perfluoropolyether, and a photoinitiator, wherein a weight ratio of the first monomer to the second monomer is from about 90:10 to about 60:40.

* * * * *